US005785453A

United States Patent [19]

Marty et al.

[11] Patent Number: 5,785,453

[45] Date of Patent: Jul. 28, 1998

[54] CHARIOT FOR DEPRESSING PAVEMENT MARKING TAPE

[75] Inventors: John L. Marty, White Bear Lake; James P. McAuley, Shoreview, both of Minn.

[73] Assignee: Minnesota Mining and Manufacturing Company, St. Paul, Minn.

[21] Appl. No.: 670,073

[22] Filed: Jun. 25, 1996

[51] Int. Cl.[6] ..... E01C 23/16; B62D 63/00

[52] U.S. Cl. ..... 404/94; 280/32.7

[58] Field of Search ..... 404/93, 94; 280/32.7; 180/15

[56] References Cited

U.S. PATENT DOCUMENTS

| | | | |
|---|---|---|---|
| 654,000 | 7/1900 | Howard | 280/32.7 |
| 842,438 | 1/1907 | Turner | 280/32.7 |
| 887,305 | 5/1908 | Bloom | 280/32.7 |
| 2,218,064 | 10/1940 | Amsbury | 280/32.7 |
| 2,740,462 | 4/1956 | Stegeman | 280/32.7 |
| 2,919,756 | 1/1960 | Knipe | 280/32.7 |
| 3,190,672 | 6/1965 | Swanson et al. | 280/32.7 |
| 3,279,336 | 10/1966 | Eaton et al. | 94/44 |
| 3,393,615 | 7/1968 | Micheln | 94/39 |
| 3,844,669 | 10/1974 | Eigenmann | 404/94 |
| 3,864,052 | 2/1975 | Blomberg | 404/94 |
| 3,874,801 | 4/1975 | White | 401/2 |
| 4,030,958 | 6/1977 | Stenemann | 156/350 |
| 4,192,525 | 3/1980 | Clark | 280/443 |
| 4,242,173 | 12/1980 | Stenemann | 156/523 |
| 4,623,280 | 11/1986 | Stenemann | 404/94 |
| 4,828,282 | 5/1989 | Pinto | 280/32.7 |
| 4,861,190 | 8/1989 | Glassel | 404/93 |
| 4,878,339 | 11/1989 | Marier et al. | 56/14.7 |
| 4,974,990 | 12/1990 | Anderson et al. | 404/94 |
| 4,989,351 | 2/1991 | Shear | 37/242 |
| 4,998,948 | 3/1991 | Osterling | 56/12.6 |
| 5,059,061 | 10/1991 | Stenemann | 404/72 |
| 5,117,944 | 6/1992 | Hurtevent | 187/9 R |
| 5,118,123 | 6/1992 | Betrock | 280/32.7 |
| 5,120,154 | 6/1992 | Lasch et al. | 404/14 |
| 5,388,850 | 2/1995 | Simone | 280/442 |
| 5,413,364 | 5/1995 | Hafendorfer | 280/32.7 |
| 5,564,721 | 10/1996 | Wians | 280/32.7 |

FOREIGN PATENT DOCUMENTS

| | | | |
|---|---|---|---|
| 0 177 452 | 4/1986 | European Pat. Off. . | |
| 0 507 714 | 10/1992 | European Pat. Off. . | |
| 2 723 753 | 2/1996 | France . | |
| 1-207508 | 8/1989 | Japan | 404/93 |
| 443 385 | 2/1968 | Switzerland . | |

OTHER PUBLICATIONS

U.S. Trademark "SCOTCH-LANE", registered Mar. 28, 1967 Brochure entitled Jungle Wheels; Jungle Jim's Accessory Products, Inc. Undated.

*Primary Examiner*—Tamara L. Graysay
*Assistant Examiner*—Gary S. Hartmann
*Attorney, Agent, or Firm*—Peter L. Olson

[57] ABSTRACT

A chariot for use with a self-propelled pavement marking tape applicator. The chariot allows a single operator to apply pavement marking tape with the applicator and to depress the tape against a road surface by means of one or more rollers supporting the chariot and the operator.

7 Claims, 5 Drawing Sheets

CHARIOT FOR DEPRESSING PAVEMENT MARKING TAPE

FIELD OF THE INVENTION

The invention relates to a chariot for use with a self-propelled pavement marking tape applicator, which depresses the tape against a road surface to improve adhesion between the two.

BACKGROUND OF THE INVENTION

Pavement marking tape has been used for many years to define lanes on a road or lines in a parking lot, for example. The tape has a highly visible front surface, and pressure sensitive adhesive coated on the back surface to permit the tape to be applied to a road surface. Pavement marking tape is generally available in rolls of 100 to 300 yards in length, and those rolls weigh approximately 32 kg (70 lbs.). Because two rolls are often used together to apply parallel lines on the road surface, the apparatus used to carry and apply such rolls may be quite heavy and perhaps unwieldy. To facilitate the application of pavement marking tape, a self-propelled pavement marking tape applicator has been designed and sold by the assignee of the present invention, Minnesota Mining and Manufacturing Company (3M Company) of St. Paul, Minn., under the designation MMHTA-18.

FIG. 1 illustrates a self-propelled pavement marking tape applicator of the type sold by 3M Company. It includes an engine that is connected to the drive wheels by means of a slip-clutch assembly, so that an operator can accurately control the amount of power transferred from the engine to the drive wheels. Also mounted to the frame of the applicator are support members for holding one or more rolls of pavement marking tape, which are unwound and applied to the road surface.

Once the pavement marking tape has been applied to the road surface, it must be depressed against the surface to insure optimum adhesion. This process is much like running one's finger over the length of a piece of adhesive tape to secure the tape to a paper, or to a package. Because pavement marking tapes are subject to harsh environmental conditions, including large variations in ambient temperature and impact from automobile tires, the tape should be depressed under a large weight—preferably about 113 kilograms (250 lbs)—to secure the tape to the road surface. This is typically done using a separate rolling or tamping apparatus such as that shown in FIG. 2.

The rolling apparatus in FIG. 2 includes a roller that is sufficiently wide to depress the entire width of the pavement marking tape, a platform for supporting weights, and a handle. The entire apparatus, including the weights, typically weighs about 113 kg (250 lbs). In use, the operator grasps the handle and pushes the apparatus over the pavement marking tape, just after the tape has been applied to the road surface as described above. The rolling apparatus thus depresses the tape against the road surface to insure proper adhesion.

Although the apparatus illustrated in FIG. 2 works well, its substantial weight renders it a physically taxing tool, especially when the apparatus must be pushed over many meters or kilometers of tape. However, if the apparatus is not used, the tape will be less well adhered to the road surface, and may prematurely tear, bubble, or peel off. Also, the application and depression of pavement marking tape in two separate operations typically necessitates two operators, which is expensive. Thus, it is desirable to provide a more convenient manner of depressing pavement marking tape against a road surface.

SUMMARY OF THE INVENTION

The present invention is a chariot for use with a self-propelled applicator for applying marking tape. The chariot includes a means for supporting an operator, roller means for depressing the marking tape against a surface, and means for coupling the chariot to the applicator. Thus, the operator can stand on a platform, and use the operator's weight to depress the marking tape against the road surface.

DETAILED DESCRIPTION OF THE PREFERRED EMBODIMENT

Figure 1:
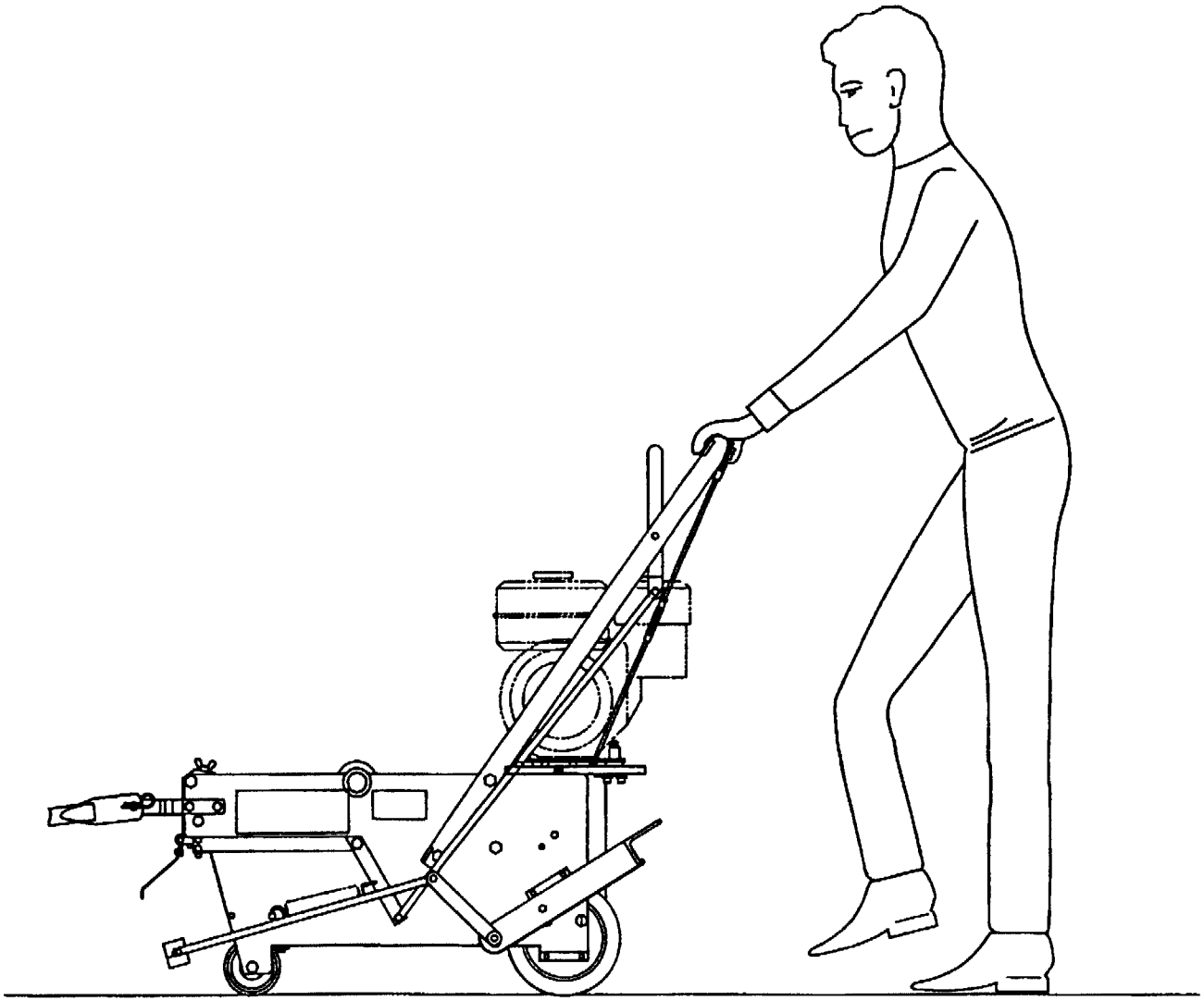
Fig. 1 PRIOR ART
FIG. 1 is a side view of a self-propelled pavement marking tape applicator.
Figure 2:
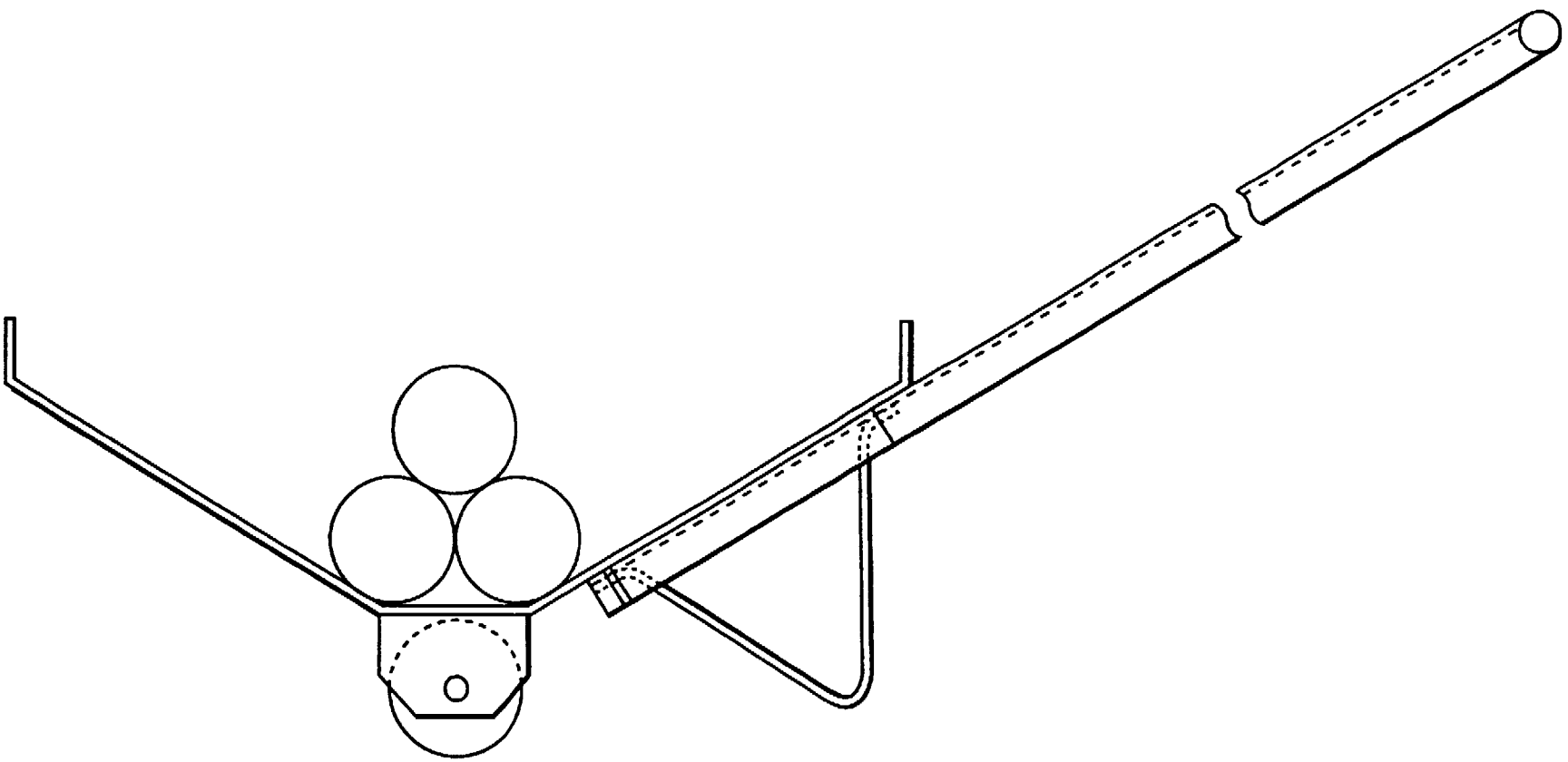
Fig. 2 PRIOR ART
FIG. 2 is a side view of a rolling apparatus for depressing the pavement marking tape against the road surface.
Figure 3:
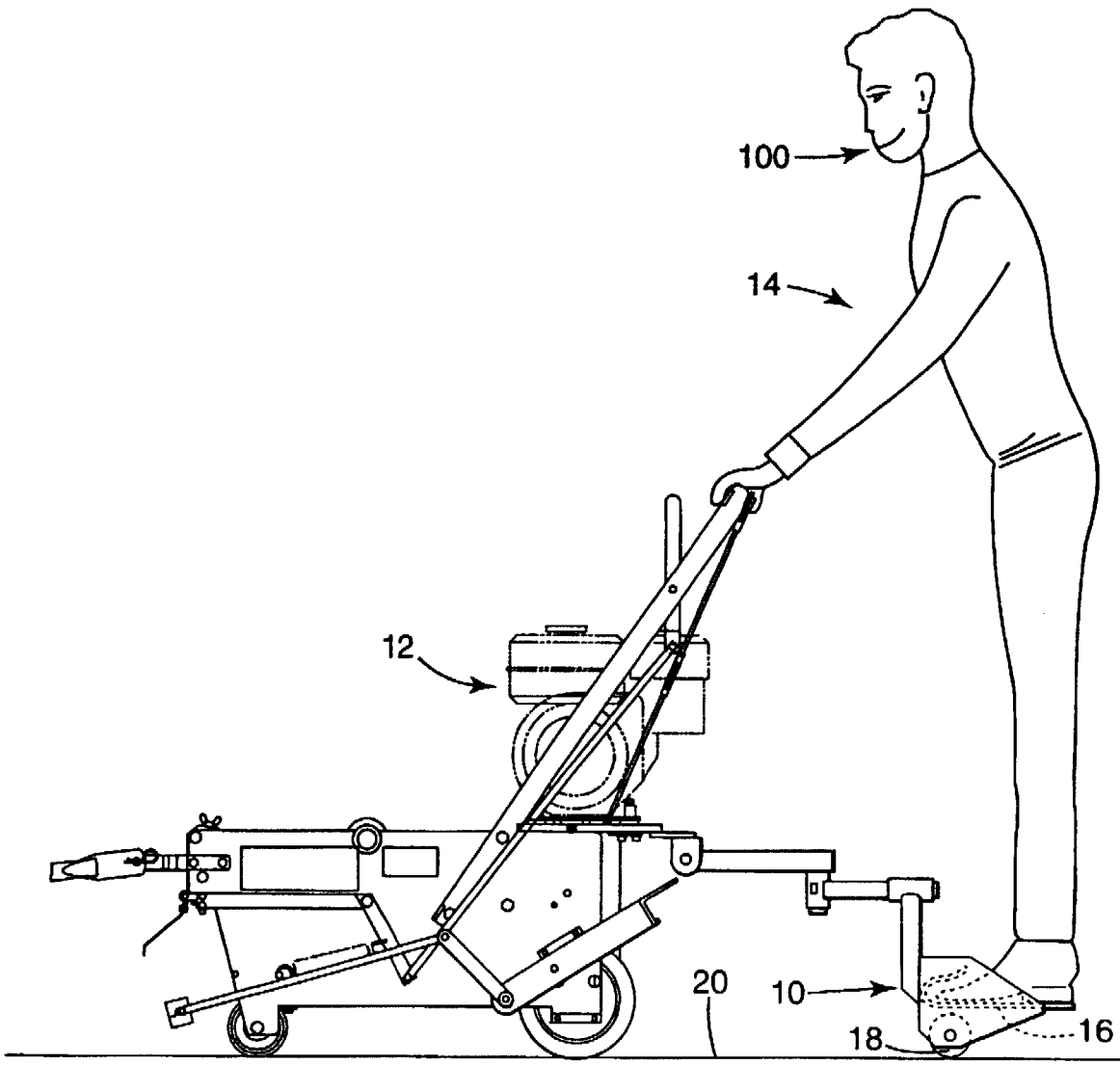
FIG. 3 is a side view of the chariot of the present invention.

The apparatus of the present invention is referred to herein as a chariot, because it is attached to and pulled behind a self-propelled pavement marking tape applicator, as shown in FIG. 3 and described below. It carries the operator, and thus uses the weight of the operator to depress the tape against the road surface. Thus, the chariot enables one operator to apply the pavement marking tape to, and depress it against, a road surface to obtain maximum adhesion. Furthermore, the operator need not walk, as with conventional processes, which simplifies the application of long distances of pavement marking tape, with substantially less operator fatigue.

FIG. 3 illustrates one embodiment of the chariot 10 of the present invention. The chariot is pivotally attached to a self-propelled pavement marking tape applicator 12, as described below in reference to FIG. 5, and supports the weight of a standing operator 14 on platform 16. The platform is supported by one or more rollers 18, which typically extend across the entire width of the chariot to insure that the roller depresses the entire width of the pavement marking tape 20. In the standing position, the operator can manipulate the controls of the applicator to steer, accelerate, or brake both the apparatus and the chariot. Naturally, the chariot moves at the same speed as the applicator, and thus requires only a single operator to perform both the application and depressing steps previously described.

Figure 4:
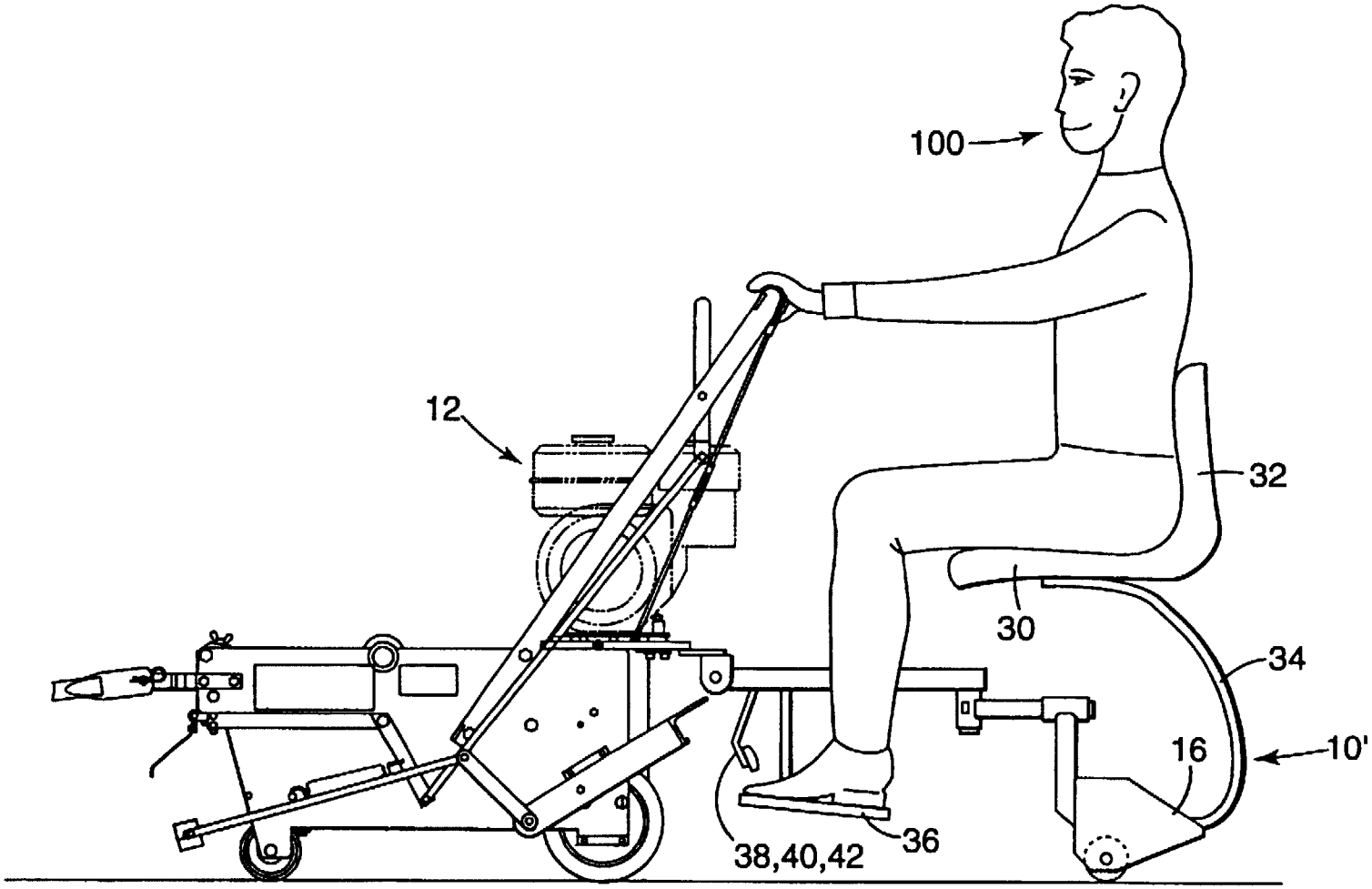
FIG. 4 is a side view of a second embodiment of the chariot of the present invention.

FIG. 4 illustrates a second embodiment of a chariot 10', which includes a seat 30 (including an optional backrest 32) attached to platform 16 so that the operator may operate the applicator 12 from a seated position. The seat may be attached by, for example, a bow spring 34, to provide a cushioning effect in response to bumps in the road surface. A footrest 36 may also be provided, and accelerator, braking, and clutch pedals 38, 40, and 42 may be provided adjacent the footrest to permit the operator to control those operations with her feet.

Figure 5:
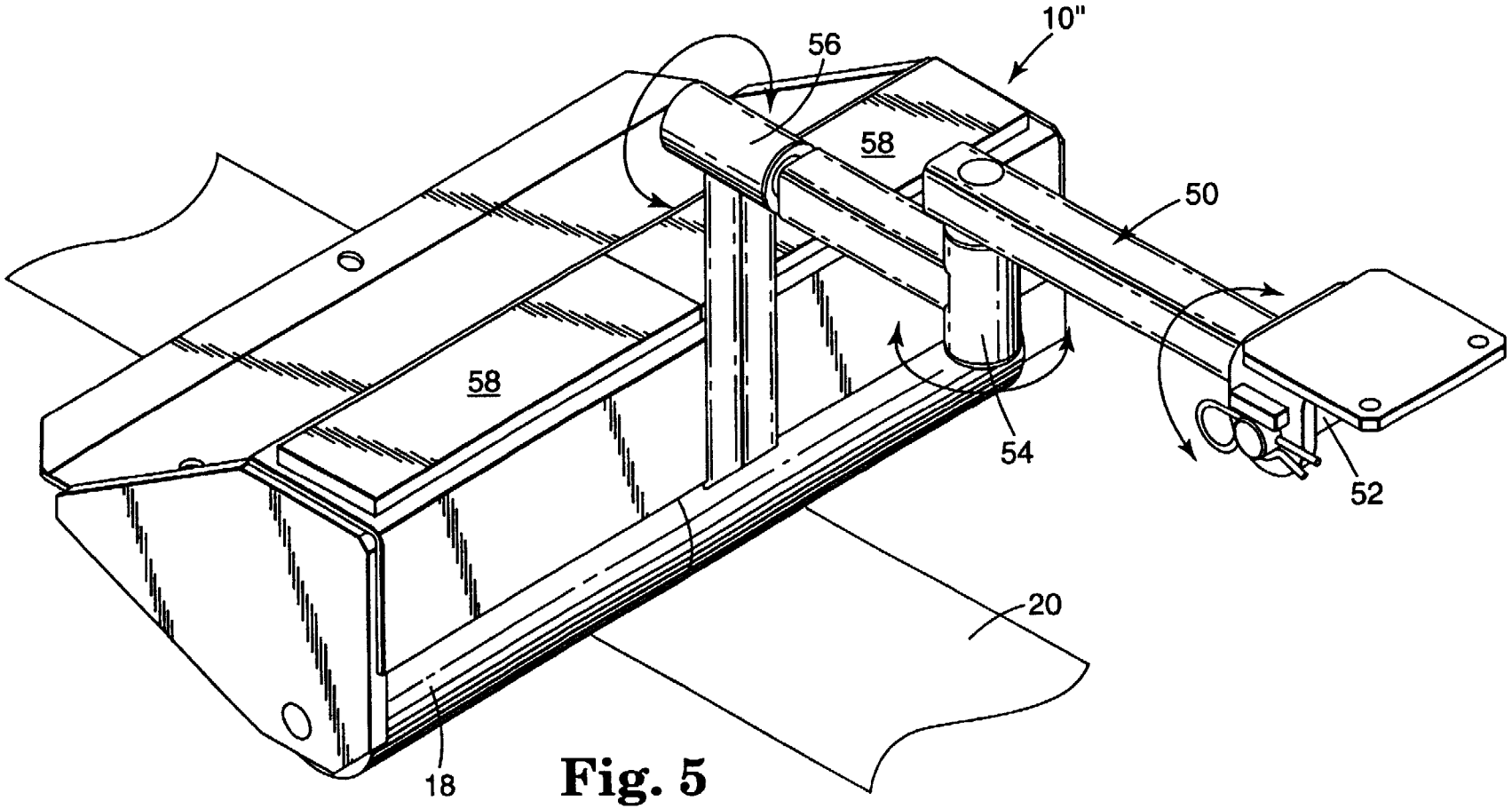
FIG. 5 is a perspective view of the chariot of the present invention.

FIG. 5 illustrates an exemplary swing-arm mechanism 50 for attaching chariot 10" to the self-propelled pavement marking tape applicator. Mechanism 50 includes joints 52, 54, and 56, which enable the chariot to pivot along the transverse, vertical, and longitudinal rotational axes with respect to the applicator. The three joints may be arranged in any suitable order, and may be replaced with any suitable mechanism that provides movement about the three axes. For example, a single ball-and-socket mechanism may be substituted for the three joints shown in FIG. 5. Also shown in FIG. 5 are additional weights 58, which may be used to further increase the force applied to the pavement marking tape by the chariot and operator.

The chariot may be made of any suitable material, one example of which is plate steel. The rollers 18 are preferably silicone rubber, and have a Shore "A" durometer of approximately 45. Silicone is preferred because it is less likely to stick to fresh, warm asphalt than other rubber materials. Although rollers 18 are shown as extending across the entire width of the chariot, they could be provided in the center or toward the outside edges of the chariot, depending upon the size and number of pavement marking tapes being applied. Because pavement marking tapes can be up to 46 cm (18 in) wide, it is preferred that the rollers are at least 46 cm (18 in) wide to insure that the rollers contact the entire width of the tape.

Although the chariot of the present invention can be easily fabricated with conventional materials, one method of making such a chariot is to modify an existing apparatus. That apparatus, available from Jungle Jim's Accessory Products, Inc. of Louisville, Ky. 40243 under the designation "Jungle Wheels," is sold for use by an operator of a self-propelled lawn mower. It includes a platform supported by a wheel on each side of the platform. To modify the apparatus, the side wheels and axles are removed, and an axle and roller assembly is secured beneath the platform. Thus, the roller rolls over applied pavement marking tape in the manner described herein.

The result of the present invention is an easier, more efficient, and more effective method of depressing a pavement marking tape against a road surface. Operators may even begin to enjoy this portion of a road work job (see 100).

Although the invention has been described with respect to specific embodiments, other embodiments using the concepts underlying the present invention are possible without departing from the scope of the invention, which is defined by the following claims.

We claim:

1. An apparatus for applying pavement marking tape and tamping it against a surface, comprising:

(a) a self-propelled applicator for carrying a supply of pavement marking tape and applying it to the surface; and (b) a chariot coupled to the applicator to roll over the applied tape, the chariot including structure for supporting an operator, and at least one roller disposed beneath the support structure for tamping the applied marking tape against the surface with the weight of the operator.

2. The chariot of claim 1, wherein the supporting structure comprises a platform.

3. The chariot of claim 1, wherein the supporting structure comprises a seat affixed to the chariot.

4. The chariot of claim 3, wherein the roller has an exposed rubber surface.

5. The chariot of claim 4, wherein the rubber is silicone rubber.

6. The chariot of claim 1, wherein the chariot is coupled to the applicator by at least one joint that accommodates relative movement between the chariot and the applicator.

7. The chariot of claim 6, wherein the chariot is coupled to the applicator by a series of three joints, each of which accommodates relative rotation of the chariot and the applicator about one of three mutually orthogonal axes.

* * * * *